United States Patent [19]

Alvarez et al.

[11] 4,150,456

[45] Apr. 24, 1979

[54] FLOOR SCRUBBER AND BUFFER

[76] Inventors: David M. Alvarez, 3222 Street Rd., Cornwell Heights, Pa. 19020; John M. Alvarez, P.O. Box 117, Wycombe, Pa. 18980

[21] Appl. No.: 922,767

[22] Filed: Jul. 7, 1978

[51] Int. Cl.[2] ..... A47L 11/283

[52] U.S. Cl. ..... 15/49 R; 15/246

[58] Field of Search ..... 15/38, 48, 49 R, 50 R, 15/98, 246, 142

[56] References Cited

U.S. PATENT DOCUMENTS

| | | | |
|---|---|---|---|
| 2,142,933 | 1/1939 | Bickford | 15/49 R |
| 2,977,620 | 4/1961 | Nilsson | 15/142 |
| 3,263,256 | 8/1966 | Ruehmann | 15/50 R |

*Primary Examiner*—Edward L. Roberts

*Attorney, Agent, or Firm*—William C. Babcock

[57] ABSTRACT

A floor scrubber is provided with a propane powered internal combustion engine which is mounted on a wheeled dolly and which is attached by its rotary output shaft to a circular cage provided with a plurality of rotary brushes on the underside thereof. More specifically the output shaft from the internal combustion engine is connected through a pulley arrangement to the various rotary brushes and accordingly the cage and the brushes are driven in counter-rotation. Included in the structure of the dolly is a spring loaded, telescoping support for deploying a serrated clean-out bar which by angular alignment can be placed under the path of advance of the pads in the cage, thus providing a cleaning function therefor. The internal combustion engine, furthermore, is contained in a noise reducing housing which furthermore is provided with a fan for cooling.

4 Claims, 5 Drawing Figures

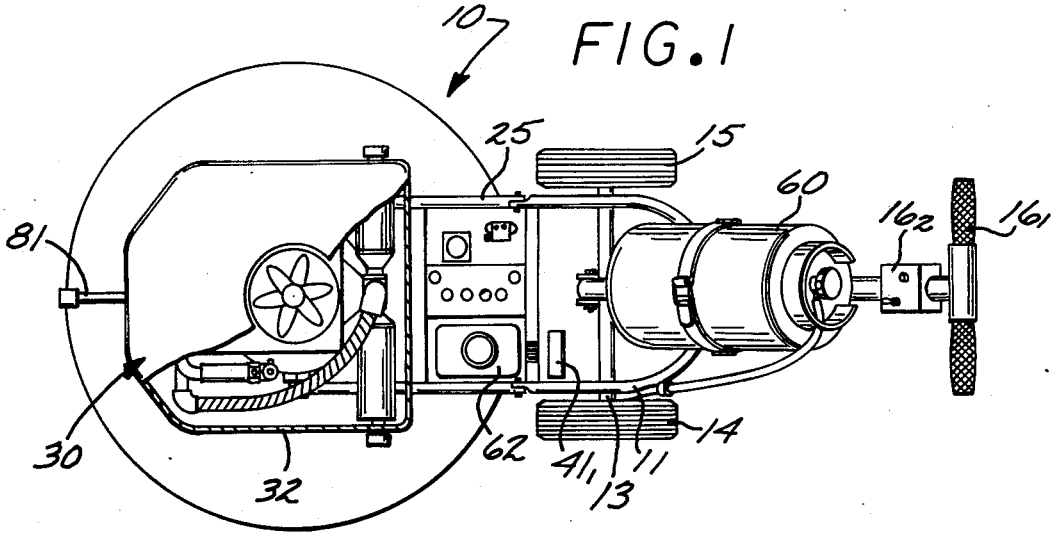
FIG. 1
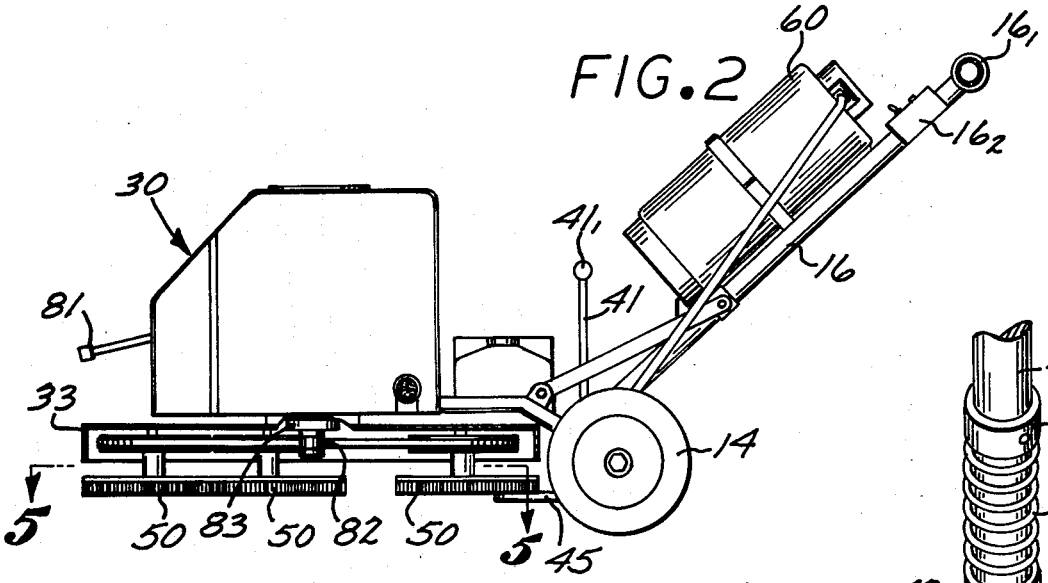
FIG. 2
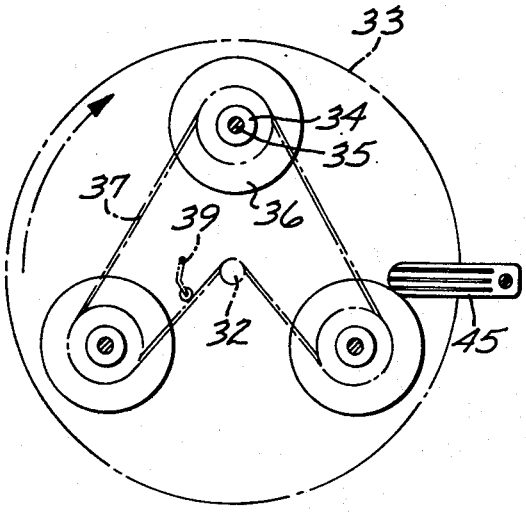
FIG. 5
FIG. 4
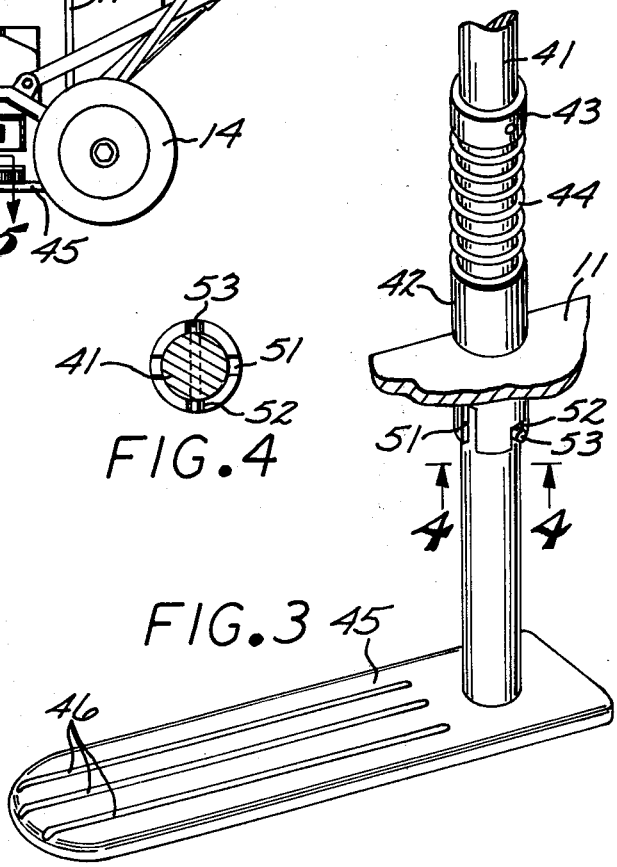
FIG. 3

FLOOR SCRUBBER AND BUFFER

BACKGROUND OF THE INVENTION

1. Field of the Invention

The present invention relates to floor scrubbers and buffers, and more particularly to improvements therein.

2. Description of the Prior Art

The use of rotary floor scrubbers and buffers has been known in the past. Most frequently such use is in residential buildings and for that reason it has been the practice to utilize electrically driven scrubbers. As labor costs have increased the desirability of larger, more powerful scrubbers has also increased. Thus the scrubbing contractor would necessarily have to employ heavy equipment which by long cords is connected to electrical power outlets of high amperage. The bulk of a cord this size and particularly the length entailed disrupts the scrubbing process since the cord has to be coiled up or uncoiled according to the deployment of the scrubber. Again, this presents an increase in man hours, a cost item which is of significant competitive advantage.

For this reason there have been developed in the past internal combustion powered scrubbers which in view of the large amounts of noxious fumes emitted could only be used in open areas or in areas where air circulation can be adequately maintained. Even in those areas the exposure of the operator to such fumes is a matter of concern and again extensive controls are entailed to insure personnel afety.

A further feature of an internal combustion engine is the noise it produces. While it is possible to reduce exhaust noise by appropriately constructed muffler the noise path through the structure of the engine itself has not been adequately provided for in the past. This noise again, presents a hazard to the operator, once more requiring elaborate techniques and controls.

SUMMARY OF THE INVENTION

Accordingly, it is the general purpose and object of the present invention to provide a floor scrubber and buffer driven by a self-contained power plant wherein the power is produced by the release of propane gas.

Additional objects of the invention are to provide a floor scrubber and buffer assembly which in the structure thereof includes means for periodic cleaning of the scrubbing brushes.

Yet additional objects of the invention are to provide a floor scrubber and buffer assembly which by virtue of its structural alignment adapts to the surface scrubbed.

Further objects of the invention are to provide a floor scrubber and buffer assembly adapted to be used with energy stored thereon.

Briefly these and other objects are accomplished within the present invention by providing an improved scrubber and buffer assembly including a handlebar connected to a wheeled dolly which extends to support a bracket extending from the wheel axle thereof to pivotally support an internal combustion engine. The engagement of the bracket to the internal combustion engine is substantially horizontal and, the pivotal axis passing through a line parallel to the wheel axle. This same pivotal axis is aligned to extend through or above the approximate weight center of the engine, thus producing a balanced configuration for a rotary cage attached at the bottom thereof. More specifically the rotary cage is suspended in rotation from the pivot receiving the output shaft of the internal combustion engine at the center thereof. The cage includes on the interior thereof a plurality of pulleys each secured to a corresponding circular brush on the underside of the cage. Each of the pulleys is in turn, connected by way of a pulley belt to the rotary output of the engine, thus producing a counter-rotating motion to the brushes while the cage is turning. Included further in the support bracket is a vertical tubular mount in which a spring loaded cleaning bar is received. This cleaning bar ends at the bottom thereof in a horizontal cleaning plate which may be deployed, by rotation, into a position intersecting the path of advance of the cleaning brushes. This cleaning plate is made out of a substantially flat piece of stock serrated over the top surface thereof to provide the necessary grooves in which the dirt is removed from the pads.

Included further on the bracket are a propane tank and a dispenser for dispensing wax. Furthermore, a propane tank is deployed on the handle bar in a counterbalancing arrangement to offset the load of the devices mounted on the bracket. This porpane tank provides the fuel for use in the internal combustion engine, thus producing the desired clean output fumes for use in residential closed areas. The foregoing configuration is furthermore provided with the necessary control for maintaining the rate of rotation of the engine, and the various other adjustment features entailed.

BRIEF DESCRIPTION OF THE DRAWINGS

FIG. 1 is a top view of a floor scrubber and buffer constructed according to the present invention;

FIG. 2 is a side view of the inventive floor scrubber and buffer shown in FIG. 1;

FIG. 3 is a perspective view of a cleaning fixture useful with the device set out herein;

FIG. 4 is a sectional view taken along line 4—4 of FIG. 3; and

FIG. 5 is yet another sectional view taken along line 5—5 of FIG. 2.

DESCRIPTION OF THE PREFERRED EMBODIMENT

As shown in FIGS. 1 and 2 the inventive scrubber assembly, generally designated by the numeral 10, comprises a support frame 11 extending from an axle housing 12 having received therein an axle 13. Axle 13, at either end, is secured to wheels 14 and 15 respectively, wheels 14 and 15 providing the dolly for the frame 11. Frame 11, furthermore, is secured to a tubular handle 16 provided with a sliding collar 17 intermediate the ends thereof. Collar 17 attaches to two braces 18 and 19 which at the other end attached, once more, to the frame. Thus braces 18 and 19 provide the necessary triangulating function to align the handle 16 in a selected alignment relative the frame. To this end, collar 17 engages the handle 16 by a wing nut assembly 20 which may be passed through various openings in the handle to select the angle. Secured to the free edge of frame 11, in substantially parallel alignment to axle housing 12, is a cantelevered U-shaped bracket 25 provided with pivot bore 26 at the free end thereof. It is through these pivot bores 26 that securing bolts 27 are passed to attach an engine assembly 30 thereto. Engine assembly 30 includes an internal combustion engine 31 pivotally supported on bolts 27, engine 31 being further attached to a noise reducing enclosure 32 provided with a cooling fan 33 at the top thereof. The alignment of engine 31 is with the output shaft 82 thereof being downwardly. Suspended on the output shaft 32 across a centrifugal clutch 83 in a circular cage 33 comprising an internally hollow circular structure free to rotate about the shaft, cage 33 including a plurality of radially spaced bearing supports 34 each supporting a shaft 35 secured to a pulley 36. Passed around the respective pulley 36 is a pulley belt 37 which is then looped around to engage by the exterior surface thereof a pulley 38 on the end of shaft 82. This belt may be tensioned by a tensioning idler 39 deployed in cage 33. In this manner pulleys 36 are driven to rotate in a counter-direction to the direction of the rotation of the cage 33. This reduces the torsional loading, minimizing the reaction required at the handle 16.

As shown in FIGS. 2, 3, 4 and 5 the foregoing assembly of parts is further provided with a cleaning device, more specifically shown as a cleaning bar 41 telescopically received in a support housing 42 attached to one edge of the frame 11 and aligned to extend substantially vertical when the bracket 25 is disposed in a horizontal plane. Engaged to the cleaning bar 41 is yet another collar 43 retaining in compression a spring 44 between the lower edge of the collar and the upper edge of the housing 42. This compression bias of spring 44 urges the cleaning bar 41 upwardly. Cleaning bar 41, furthermore, extends on the other side of housing 42 to terminate in a cantelevered cleaning plate 45 attached to the free end thereof. The cleaning plate 45 is substantially planar, extending orthonogally from bar 41 and can therefore be rotated to a position intercepting the path of advance of a plurality of circular-pads 50 respectively attached to the shafts 35 and deployed beneath cage 33. In alternative alignment the cleaning plate 45 may be rotated to a position away from the path of the pads, thus permitting the use of the foregoing device in its normal applications.

In order to achieve this alternative alignment the bottom edge of housing 42 is provided with two sets of notches or cutouts, the first set shown herein as cutouts 51 extend deeper than a second orthogonally disposed set of cutouts 52. It is within these cutouts 51 or 52 that a transverse pin 53 extending through shaft 41 is received. Thus the alignment of pin 53 in housing 42 can be controlled and furthermore the downward extension of cleaning plate 45 is similarly provided for. When the transverse pin is received, as shown, in cutout 52 plate 45 is deployed into the path of the brushes 50 opposing the brush stroke to remove the debris therefrom. To further facilitate the removal of debris plate 45 is provided on the upper surface thereof with a plurality of grooves or serrations 46 increase the rubbing contact, providing the necessary sharp edges for localized contact.

To adapt the foregoing structure for use in residential applications the engine 31 is connected to a propane tank 60 mounted on a plate 61 on the bracket 25. That same plate 61 also supports a wax dispensing canister 62 for convenience in use. Canister 62 may be connected through a motor driven impeller assembly to a spray nozzle 81 pointed ahead of the cage 33 thus dispensing wax in front of the path of advance.

The foregoing part combine to form a floor scrubber assembly which by virtue of its use of propane gas may be utilized in residential enclosures. Furthermore the use of internal combustion engine both allows for higher power rate and avoids the necessity of high amperage cords. In addition the foregoing assembly is combined with a cleaning fixture for periodic cleaning of pads thus including all the necessary features in one package to speed up work and furthermore render the transportation more convenient. The cleaning and control aspects of the foregoing assembly can be conveniently implemented, handle 16 for example terminating in a gripping structure $\mathbf{16}_1$ attached to a control $\mathbf{16}_2$ while the shaft 41 terminating in an upper end in a cross bar $\mathbf{41}_1$ for articulation.

Obviously many modifications and variations to the above disclosure can be made without departing from the spirit of the invention. It is therefore intended that the scope of the invention be determined solely on the claims appended hereto.

What is claimed is:

1. In a floor scrubber and buffer assembly including a plurality of brushes adapted for contact with a floor, power means for articulating said brushes and transporting means for translating said assembly along said floor, the improvement comprising:

a circular cage suspended for rotation from said transporting means said cage including a plurality of brush pulleys deployed at substantially equal radial positions in said cage each said brush pulley being connected to one of said brushes and aligned for rotation along axes parallel to the central axis of said cage, a counter pulley disposed proximate the center of said cage and secured to said transporting means and a pulley belt surrounding said brush pulleys and engaging by the exterior periphery thereof said counter pulley;

transmitting means connected between said cage and said power means for transmitting rotary power to said cage; and a cleaning device mounted for pivotal articulation on said transporting means and including a cleaning bar deployed for translation into or out of the path of said brushes, a support bar connected to vertically extend from said cleaning bar, a tubular housing connected to said transporting means and adapted to receive said support bar in telescopic translation, detent means formed on said housing and support bar for latching said cleaning bar in a first or second position respectively in and out of the path of translation of said brushes and spring means disposed between said housing and support bar for latching said cleaning bar in said first or second position.

2. Apparatus according to claim 1 wherein:

said cleaning bar comprises an elongate structure contelevered from one end of said support bar having an upper surface disposed to intersect the path of advance of said brushes and a plurality of longitudinal grooves formed on said upper surface.

3. Apparatus according to claim 2 wherein:

said power means includes an internal combustion engine and a source of propane gas connected to said engine for providing propane gas for fuel thereto.

4. Apparatus according to claim 3 wherein:

said internal combustion engine includes a shroud surrounding the lateral surfaces thereof.

* * * * *